US006152294A

United States Patent [19]

Weinberg

[11] Patent Number: 6,152,294

[45] Date of Patent: Nov. 28, 2000

[54] TRAVEL SOAP DISH ASSEMBLY

[76] Inventor: David C. Weinberg, 2931 Oakland Ave., Minneapolis, Minn. 55407-1303

[21] Appl. No.: 09/371,719

[22] Filed: Aug. 9, 1999

[51] Int. Cl.[7] ..... A47K 5/08

[52] U.S. Cl. ..... 206/77.1; 206/829; D6/537

[58] Field of Search ..... 206/77.1, 829; 4/628; 248/311.2; D6/537, 540; 211/41.4, 41.5; 220/487, 485, 483

[56] References Cited

U.S. PATENT DOCUMENTS

| | | | |
|---|---|---|---|
| D. 46,973 | 2/1915 | Shepard | D6/537 |
| D. 68,538 | 10/1925 | Moineau | D6/537 |
| D. 121,813 | 8/1940 | Isenberg | D6/537 |
| D. 327,596 | 7/1992 | Emery | D6/537 |
| D. 380,919 | 7/1997 | Goodman et al. | D6/537 |
| 553,467 | 1/1896 | Huebel | 206/77.1 |
| 570,666 | 11/1896 | Huebel | 206/77.1 |
| 1,085,022 | 1/1914 | Condit | 206/77.1 |
| 2,356,056 | 8/1944 | Hogg | 206/77.1 |
| 4,934,640 | 6/1990 | Bichon | D6/537 |
| 5,279,412 | 1/1994 | Lee | 206/77.1 |

*Primary Examiner*—Paul T. Sewell
*Assistant Examiner*—Shian Luong
*Attorney, Agent, or Firm*—Michael S. Neustel

[57] ABSTRACT

A travel soap dish assembly for use within shower or upon a surface of a sink without significant residue buildup while maintaining the bar soap significantly dry. The inventive device includes a container, a cover pivotally attached to the container, a plurality of slots extending into the edge of the container, a corresponding plurality of apertures connected to the slots within the container, a support frame having a plurality of shaft members that are slidably received within the slots and apertures, and corresponding plurality of suction cups attached to the shaft members. The support frame is comprised of a grid-like structure having a plurality of legs for supporting the supporting frame within the container and upon a surface of a sink. The support frame further includes a plurality of support members and cross members attached to one another forming an open bowl-like structure for retaining the bar soap. The plurality of suction cups allow the support frame to be removed and attached within the walls of a shower.

10 Claims, 4 Drawing Sheets

TRAVEL SOAP DISH ASSEMBLY

BACKGROUND OF THE INVENTION

1. Field of the Invention

The present invention relates generally to soap dishes and containers and more specifically it relates to a travel soap dish assembly for use within a shower or upon a surface of a sink without significant residue buildup.

Individuals that travel or that share showers such as dormitories, often times utilize conventional container devices to store their soap within. This allows their soap to be retrieved from the shower and reused repeatedly. However, most conventional soap containers are completely enclosed with only a few short support ribs within to keep the soap above the floor of the soap container. Because the bar soap is wet when it is placed back into the soap container, residue from the bar soap collects within the floor of the soap container thereby creating an undesirable buildup. In addition, if the user desires to utilize the soap container within a shower, when the lid of the container is opened, water enters the soap container that must either be removed or left within to further cause destruction of the soap bar. Hence, there is a need for a soap dish assembly that reduces the amount of buildup within the container and that is usable within a shower without the buildup of water or other fluids.

2. Description of the Prior Art

Soap dishes and containers have been in use for years. Typically, a soap dish comprises a solid tray structure having a plurality of rib support members that support the bar soap above the floor within the convention soap dish. The conventional soap dish has a bowl or basin shape for receiving the bar soap and preventing the bar soap from accidentally being removed. Conventional soap containers are comprised of a solid tray structure with a plurality of rib support member within the floor, and a pivotally attached lid for enclosing the tray structure.

Conventional soap dishes and containers accumulate residue from the bar soap when the bar soap is wet. This soap residue maintains the lower portion of the bar soap moist thereby causing the further deterioration of the bar soap when in storage. In addition, conventional soap dishes and containers are difficult to remove the accumulated soap residue. To remove the accumulated soap residue from within the soap dish or container, the user must place the entire dish or container directly under a flow of water and simultaneously utilize their fingers to manipulate the soap residue.

Examples of soap dishes and containers include U.S. Pat. No. 4,934,640 to Bichon; and U.S. Pat. No. 4,858,757 to Liggett which are all illustrative of such prior art.

Bichon (U.S. Pat. No. 4,934,640) discloses a portable container for soap. Bichon teaches a dish portion with a hinged fastenable lid, and a plurality of suction cups extending from the dish portion which allow the dish portion to be mounted within a shower.

Liggett (U.S. Pat. No. 4,858,757) discloses a combined package and dish for a soap bar product. Liggett teaches a structure having an open bottom and top, and a plurality of dowels within the lower portion of the structure for supporting a soap bar.

Rupp (U.S. Pat. No. 4,588,075) discloses a portable soap holder. Rupp teaches a base, a pair of protruding members from the base, and a suction cup attached to the base opposite of the protruding members.

While these devices may be suitable for the particular purpose to which they address, they are not as suitable for use within a shower or upon a surface of a sink without significant residue buildup. Conventional soap dishes and containers allow the accumulation of soap residue and water thereby leading to the contamination and deterioration of the soap bar while in storage. In addition, conventional soap dishes and containers are not easily cleaned without significant effort on the part of the user.

In these respects, the travel soap dish assembly according to the present invention substantially departs from the conventional concepts and designs of the prior art, and in so doing provides an apparatus primarily developed for the purpose of use within a shower or upon a surface of a sink without significant residue buildup.

SUMMARY OF THE INVENTION

In view of the foregoing disadvantages inherent in the known types of soap dishes and containers now present in the prior art, the present invention provides a new travel soap dish assembly construction wherein the same can be utilized for use within a shower or upon a surface of a sink without significant residue buildup.

The general purpose of the present invention, which will be described subsequently in greater detail, is to provide a new travel soap dish assembly that has many of the advantages of the soap dishes and container devices mentioned heretofore and many novel features that result in a new travel soap dish assembly which is not anticipated, rendered obvious, suggested, or even implied by any of the prior art soap dishes and containers, either alone or in any combination thereof.

To attain this, the present invention generally comprises a container, a cover pivotally attached to the container, a plurality of slots extending into the edge of the container, a corresponding plurality of apertures connected to the slots within the container, a support frame having a plurality of shaft members that are slidably received within the slots and apertures, and corresponding plurality of suction cups attached to the shaft members. The support frame is comprised of a grid-like structure having a plurality of legs for supporting the supporting frame within the container and upon a surface of a sink. The support frame further includes a plurality of support members and cross members attached to one another forming an open bowl-like structure for retaining the bar soap. The plurality of suction cups allow the support frame to be removed and attached within the walls of a shower.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a travel soap dish assembly that will overcome the shortcomings of the prior art devices.

Another object is to provide a travel soap dish assembly that may be utilized within a shower or upon a sink.

An additional object is to provide a travel soap dish assembly that conveniently stores a bar soap without contamination or deterioration of the bar soap while in storage.

A further object is to provide a travel soap dish assembly that maintains the bar soap substantially dry at all times.

Another object is to provide a travel soap dish assembly that allows a user to utilize the same bar soap repeatedly over a significant period of time.

Another object is to provide a travel soap dish assembly that is easy to clean.

A further object is to provide a travel soap dish assembly that may be attached to the walls of a shower.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
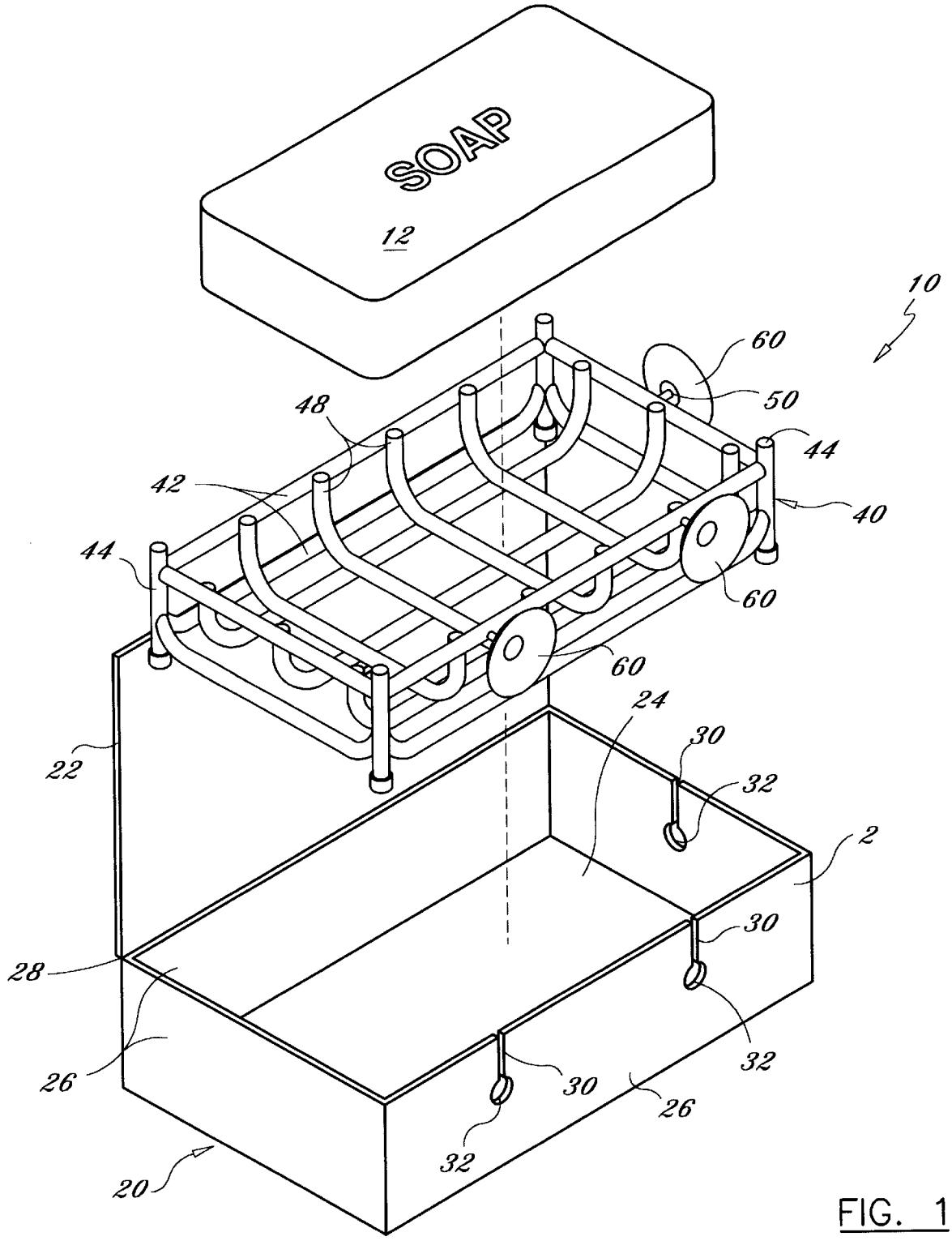
FIG. 1 is an exploded upper perspective view of the present invention.

Turning now descriptively to the drawings, in which similar reference characters denote similar elements throughout the several view, FIGS. 1 through 5 illustrate a travel soap dish assembly 10, which comprises a container 20, a cover 22 pivotally attached to the container 20, a plurality of slots 30 extending into the edge of the container 20, a corresponding plurality of apertures 32 connected to the slots 30 within the container 20, a support frame 40 having a plurality of shaft members 50 that are slidably received within the slots 30 and apertures 32, and corresponding plurality of suction cups 60 attached to the shaft members 50. The support frame 40 is comprised of a grid-like structure having a plurality of legs 44 for supporting the supporting frame within the container 20 and upon a surface of a sink 16. The support frame 40 further includes a plurality of support members 46 and cross members 48 attached to one another forming an open bowl-like structure for retaining the bar soap 12. The plurality of suction cups 60 allow the support frame 40 to be removed and attached within the walls of a shower 14.

As best shown in FIG. 1 of the drawings, the container 20 is preferably of a rectangular structure, however it can be appreciated that various other shapes and designs may be utilized for the container 20. The container 20 preferably has a plurality of side walls 26 creating an upper opening, a floor 24, and a cover 22 pivotally attached to at least one of the side walls 26 by a hinge 28.

The container 20 is preferably constructed of a plastic material, however it can be appreciated that various other types of well-known materials may be utilized to construct the container 20. In addition, it can be appreciated that a latch means would be utilized for securing the cover 22 about the upper opening created by the side walls 26.

As further shown in FIG. 1 of the drawings, the side walls 26 of the container 20 include a plurality of slots 30 extending substantially vertically downwardly from the upper edge of the container 20. The lower portion of the slots 30 are connected to a broader corresponding plurality of apertures 32 as further shown in FIG. 1 of the drawings.

Figure 2:
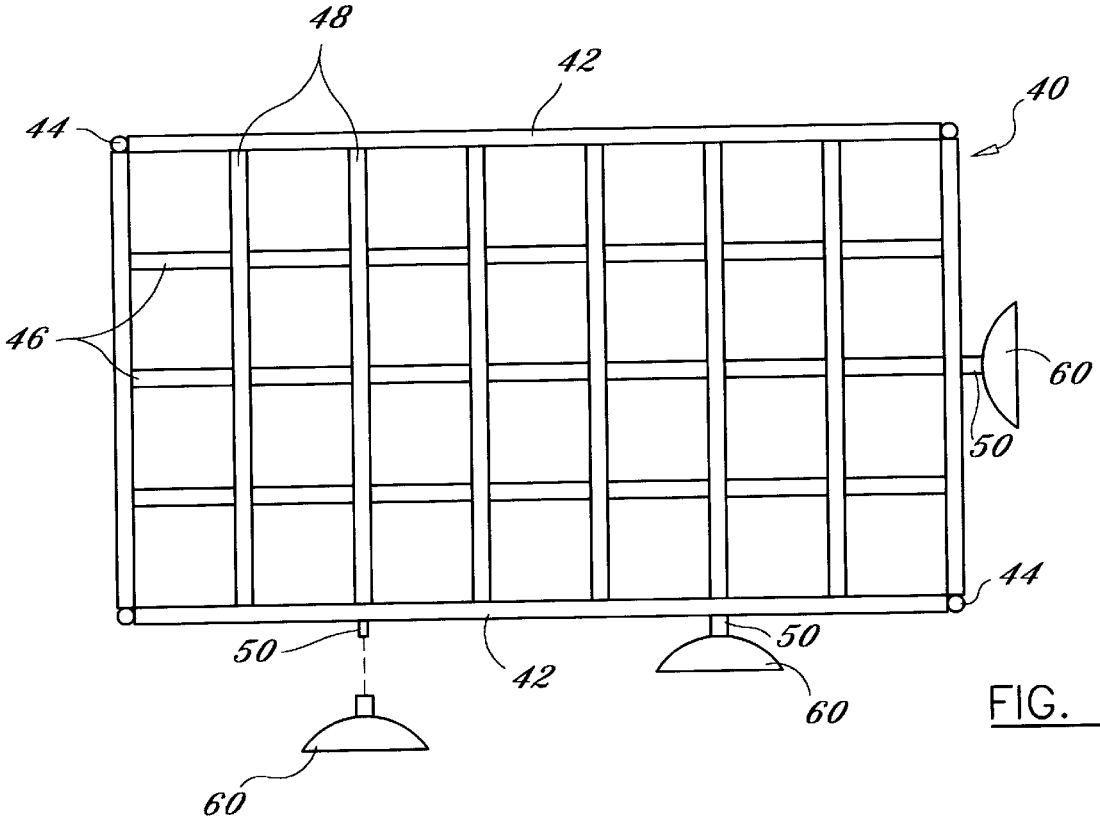
FIG. 2 is a top view of the support frame.
Figure 3:
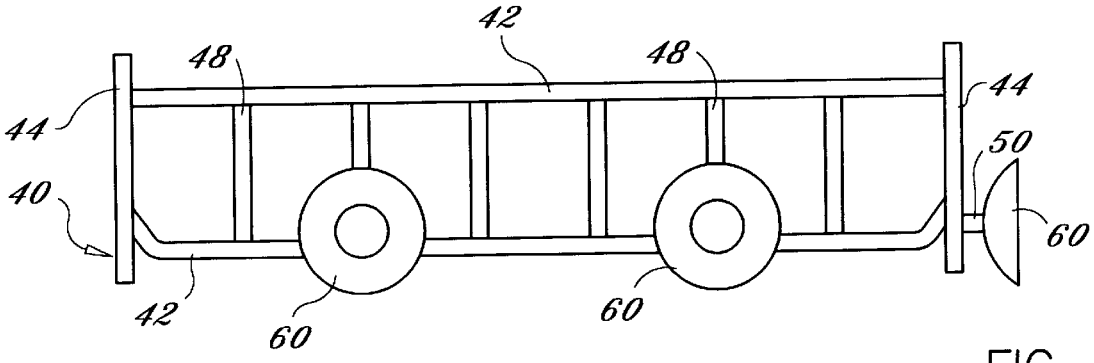
FIG. 3 is a side view of the support frame showing the suction cups.

As shown in FIGS. 1 through 3 of the drawings, the support frame 40 includes a plurality of legs 44, a plurality of side members 42 attached to the upper portion and lower portion of the legs 44, a plurality of support member extending between the side members 42 along the longitudinal axis of the support frame 40, and a plurality of cross member secured between the side member orthogonally to the support members 46. The support frame 40 is preferably comprised of a wire material covered with a rubber coating commonly found upon conventional shower 14 devices.

Figure 4:
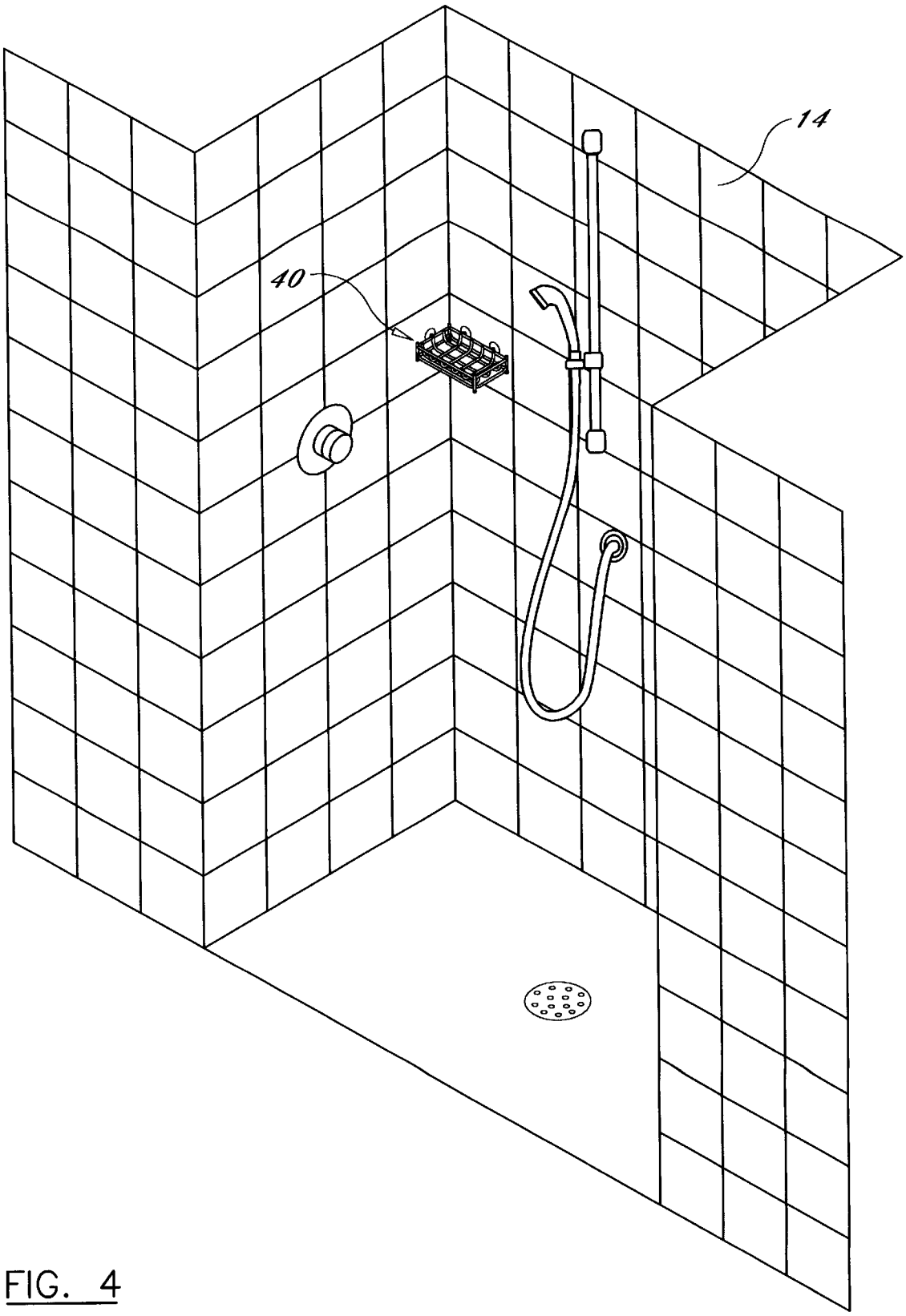
FIG. 4 is upper perspective view of the present invention attached within a shower.
Figure 5:
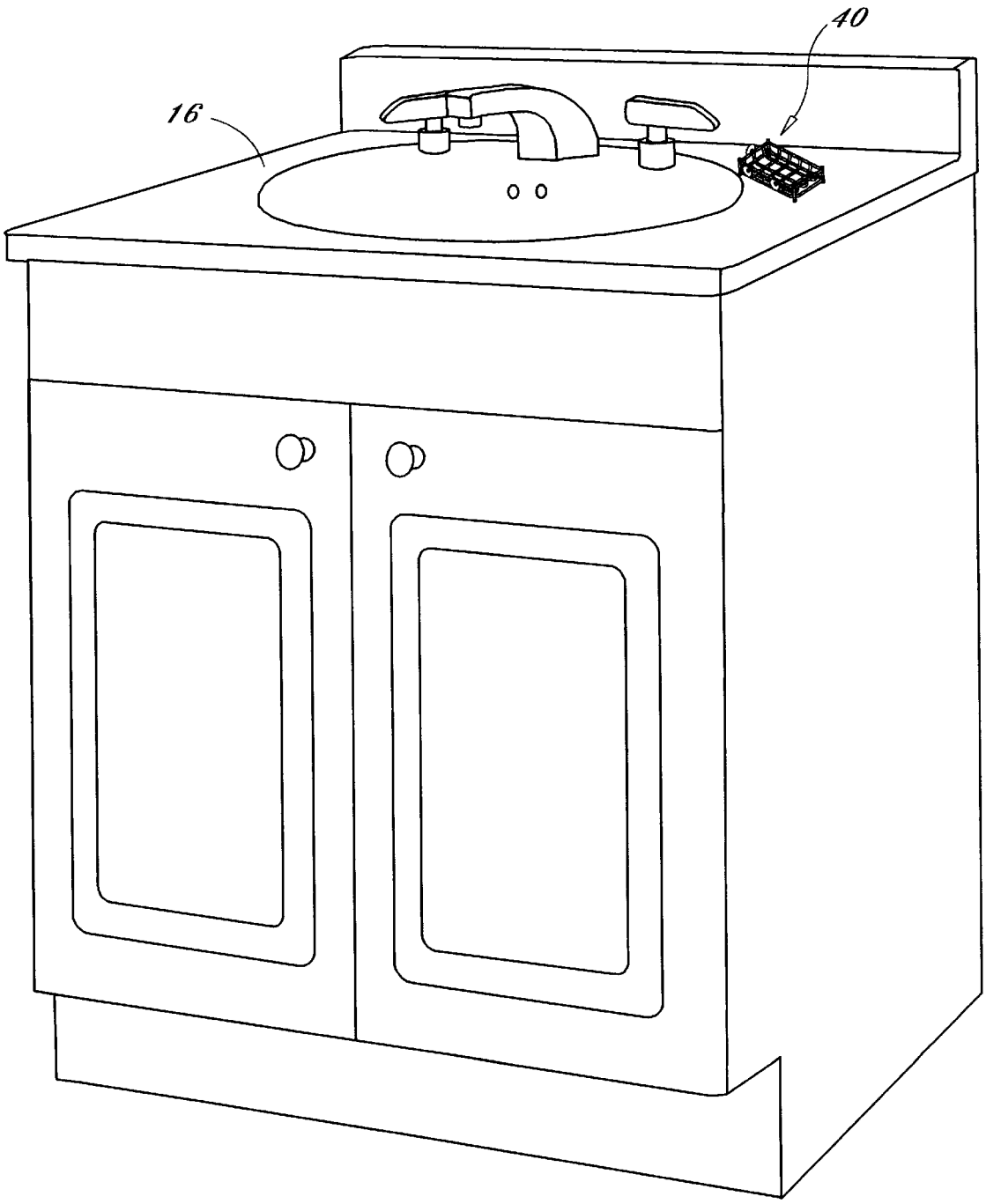
FIG. 5 is an upper perspective view of the present invention positioned upon a surface of a sink.

As shown in FIGS. 1 through 3 of the drawings, a plurality of shaft members 50 extend from the support frame 40. As shown in FIG. 1 of the drawings, the shaft members 50 are slidably within the slots 30 and are retainable within the apertures 32 of the container 20. This allows the support frame 40 to be removed for cleaning or utilization upon a sink 16 or within a shower 14. A corresponding plurality of suction cups 60 are attached to the distal ends of the shaft members 50 for allowing the support frame 40 to be attached to the walls of a conventional shower 14 as shown in FIG. 4 of the drawings. The suction cups 60 are preferably removable for when the invention is placed directly upon a flat surface such as a sink 16 to avoid interference by the suction cups.

In use, the user either secures the invention to the side walls 26 of the shower 14 or positions the support frame 40 upon the surface of a sink 16 with the bar soap 12 within. The individual thereafter utilizes the bar soap 12 as they normally would. When the individual must travel to another location, the individual simply positions the support frame 40 along with the bar soap 12 into the container 20 so that the shaft members 50 slide through the slots 30 into the apertures 32 where they are retained. The user then closes the cover 22 and then travels to the next location. The user simply repeats the above process after removing the support frame 40 from the container 20.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A travel soap dish assembly, comprising:

a container having at least one side wall, a floor and an upper opening;

a plurality of slots extending into an upper edge of said at least one side wall;

a support frame having a plurality of legs for receiving a soap bar;

a plurality of shaft members extending from said support frame, wherein said plurality of shaft members are positionable within said plurality of slots of said container; and a plurality of suction cups attached to said shaft members.

2. The travel soap dish assembly of claim 1, wherein said support frame includes a plurality of support members extending along a longitudinal axis of said support frame.

3. The travel soap dish assembly of claim 2, wherein said support frame includes a plurality of cross members substantially orthogonal with respect to said plurality of support members.

4. The travel soap dish assembly of claim 3, wherein said support frame forms a structure having a cavity for receiving said bar soap.

5. The travel soap dish assembly of claim 1, wherein said at least one side wall includes a plurality of apertures connected to said plurality of slots.

6. The travel soap dish assembly of claim 5, wherein said support frame is constructed of a rigid material.

7. The travel soap dish assembly of claim 6, wherein said support frame is covered with a rubber coating.

8. The travel soap dish assembly of claim 7, wherein said plurality of legs comprises four legs extending substantially vertically.

9. The travel soap dish assembly of claim 8, wherein said legs include a rubber boot upon a lower distal end for engaging the surface of a sink.

10. The travel soap dish assembly of claim 9, wherein said plurality of shaft members and said plurality of suction cups are attached to at least two adjacent sides of said support frame, wherein said suction cups are removable.

* * * * *